US006461404B1

(12) United States Patent
Irons et al.

(10) Patent No.: US 6,461,404 B1
(45) Date of Patent: Oct. 8, 2002

(54) LADLE FOR ENHANCED STEEL VACUUM DECARBURIZATION

(75) Inventors: Gordon Irons, Dundas; Diancai Guo, Weston, both of (CA)

(73) Assignee: McMaster University, Hamilton (CA)

( * ) Notice: Subject to any disclaimer, the term of this patent is extended or adjusted under 35 U.S.C. 154(b) by 0 days.

(21) Appl. No.: 09/568,420

(22) Filed: May 10, 2000

(30) Foreign Application Priority Data

May 31, 1999 (CA) ..... 2273393

(51) Int. Cl.[7] ..... C21C 5/30
(52) U.S. Cl. ..... 75/557; 266/217; 266/233
(58) Field of Search ..... 266/220, 217, 266/218, 219, 233, 275; 75/556, 557

(56) References Cited

U.S. PATENT DOCUMENTS 3,664,652 A * 5/1972 Spire et al. ..... 266/233
3,706,549 A * 12/1972 Knuppel et al. ..... 266/217
4,636,249 A * 1/1987 Laycock et al. ..... 75/556
4,840,354 A * 6/1989 LaBate ..... 266/218

FOREIGN PATENT DOCUMENTS

WO WO-89/04377 * 5/1989 ..... 75/556

OTHER PUBLICATIONS

S. Kitamura et al., "The evaluation of gas–liquid reaction rate at bath surface by the gas adsorption and descorption tests," Tetsu–tu–Hagane, vol. 80 (Dec. 1994), No. 2, pp 13–18. (No translation).

* cited by examiner

*Primary Examiner*—Scott Kastler
(74) *Attorney, Agent, or Firm*—John R. S. Orange; Orange & Chari

(57) ABSTRACT

A ladle is equipped with properly positioned side and bottom injectors for enhanced steel decarburization in a vacuum tank degasser. To facilitate the circulation of liquid steel in the tank the bottom injectors are positioned in a common segment in order to create a single loop of liquid flow. To enlarge the surface area exposed to vacuum, and to increase the active surface area, supplementary gas flow is provided by side injectors located at the upper sidewall. The active surface area is enhanced by breaking bubbles released from side injectors.

22 Claims, 1 Drawing Sheet

FIG. 1.
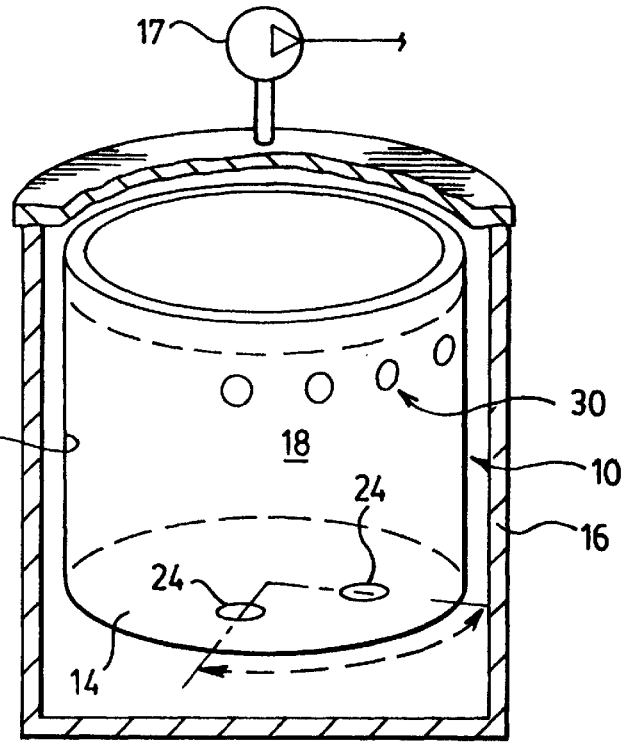
FIG. 2.
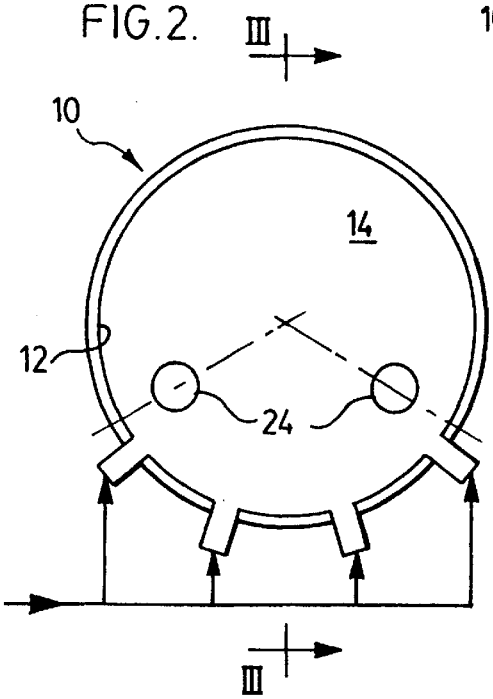
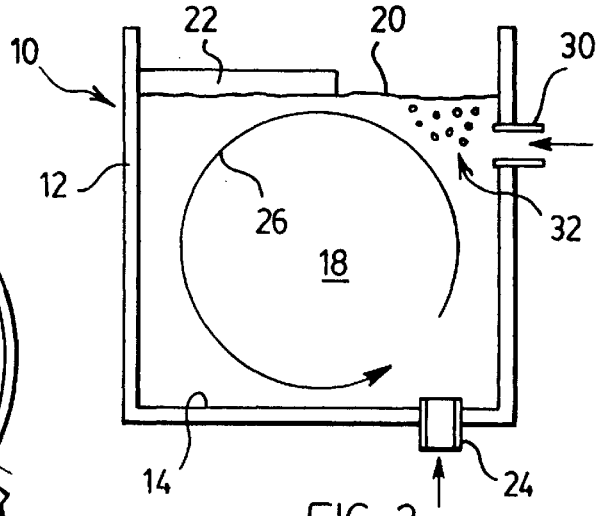
FIG. 3.

LADLE FOR ENHANCED STEEL VACUUM DECARBURIZATION

FIELD OF THE INVENTION

This invention is related to steelmaking, particularly, but not exclusively to the production of ultra low carbon steel in a tank degasser.

PRIOR ART

In recent years the demand for ultra low carbon steel (carbon content less than 40 parts per million) has been increasing. The production of this steel necessitates the use of vacuum treatment, either by the Ruhrstahl-Heraeus (hereafter RH) vacuum process, the Dortmond-Horder Huttenunion (hereafter DH) process, or the tank degassing process. The tank-degassing route has the advantage of low investment and low inert gas consumption. However, the vacuum decarburization process in a tank degasser is slower than in a RH degasser, due to limited space in which liquid steel can freely flow and splash, resulting in smaller reaction surface area. This feature extends the treatment time, reduces heat size, results in higher heat loss of liquid steel, raises the energy consumption, and reduces the capability of carbon removal. Therefore, it is desirable to improve this process.

In traditional vacuum tank degassing, a ladle holding liquid steel is placed in a vacuum chamber. Gas injectors, usually porous plugs, are installed in the ladle bottom to stir the steel. This gas injection stirring configuration is derived from conventional ladle refining process under atmospheric pressure, usually designed on the basis of liquid metal mixing time and/or top slag -metal reaction rate measurement. As such the special conditions and gas state changes associated with vacuum degassing have not been considered.

With such conventional arrangements, the plugs are positioned so that when, under vacuum, inert gas is injected from these plugs, two bubble plumes are formed bringing liquid steel flow upward. The upward velocity of steel makes the slag layer at the top separate, and form two open areas of bare steel. The circulation pattern of liquid steel is such that when steel reaches the top surface, it flows outwards along the surface, then turns downwards, and flows back to the bottom in a toroidal pattern. For most of the decarburization time, the main decarburization site is the two open areas, which is a function of gas injection rate and slag layer thickness. Limited gas injection rate produces limited open areas and limited liquid phase turbulence, preventing the enhancement of the decarburization rate. Moreover, the interaction between the two plumes creates two circulation loops in the bath, producing resistance to the liquid circulation, and reducing the renewal rate of liquid steel at the top surface.

In the past there have been some trials on side injection in steel ladles, for example, powder injection into liquid steel for desulfurization, developed by injectall. This device resembled a revolver with a rotating magazine on the outside of the ladle wall. When injector clogging occurred, it was rotated to the next injector. SAFE Company, in France, tested side injectors in ladles about 20 years ago, to avoid the bottom injector clogging by slag at the end of a cast, All these tests were carried out under atmospheric pressure.

Side injection under atmospheric pressure has a number of disadvantags. Steel in ladles is usually deoxidized with aluminum and covered by a layer of slag. To avoid oxidation by air, surface exposure due to gas blowing up the slag layer should be minimized. This necessitates a limited gas injection rate to prevent excessive surface exposure of liquid steel. Ladle refining processes are aimed at homogenizing liquid composition and temperature, enhancing alloying, and/or promoting slag-metal reactions. These procedures require the maximum mixing effect from the injected gas. Side injected gas bubbles travel less distance than those from bottom injectors, providing less liquid pumping power. Moreover, sidewall refractory erosion may increase. Therefore, side injection is considered undesirable for conventional ladle refining processes, and not practiced.

In the production of ultra low carbon steel in tank degassing, the bottom injected gas flow rate is more than enough to provide adequate mixing due to gas volume expansion. However, the liquid splashing, produced by large bubbles breaking at the bath surface, and causing steel loss and operation problems, is a major concern, and a limiting factor for further increase in gas injection rate. This is unlike the situation in a RH device, where high gas injection rate, up to 620 $Nm^3$/hour for a 260 tonne capacity device, can be used to create vigorous liquid splashing to increase the surface area of liquid metal exposed to vacuum. For a tank degasser of similar capacity, the upper limit is less than 50 $Nm^3$/hour. Therefore, the surface area exposed to vacuum in a tank is much more limited. The presence of slag in the ladle further limits the exposed surface area. Furthermore, the turbulence intensity of the liquid steel is much lower, due to less stirring energy. These are two of the key factors limiting the carbon removing capacity of a tank degasser compared to a RH degasser.

The research work of S. Kitamura et al, published in Tetsu-to-Hagane, Vol. 80(1994), No.2, pp 13–18, in a vacuum induction furnace, shows that the active surface area of liquid metal, agitated by breaking bubbles, is of primary importance for the reaction between liquid metal and gas. As vacuum decarburization is a liquid-gas reaction, an increase in the number of inert gas bubbles released from the bath will enhance the reaction. However, such side injection does not promote effectively the circulation of steel within the ladle.

It is therefore an object of the present invention to obviate or mitigate the above disadvantages in a manner that permits an increase in the gas injection rate of a steel ladle while keeping the steel splashing at an acceptable level.

SUMMARY OF THE INVENTION

According to one aspect of the present invention there is provided a method of promoting the circulation of liquid steel within a ladle having a base and a sidewall upstanding from the base, the method comprising the steps of locating a plurality of gas injectors asymmetrically in said base of said ladle and at positions relative to one another to promote a common circulatory flow path of steel in said ladle, and injecting gas through the injectors.

According to a further aspect of the invention there is provided a ladle comprising abase, sidewalls extending upwardly from the base, a plurality of injectors in the base positioned asymmetrically on the base and located relative to one another to promote a common circulatory flow path of steel in the ladle.

According to a still further aspect of the invention there is provided a method of promoting circulation of liquid steel within a ladle comprising the steps of injecting a gaseous stream into the liquid steel to promote a common circulatory flow upwardly along one side of said ladle and downwardly along another side of said ladle.

In general terms, a preferred embodiment of the invention comprises a ladle, equipped with both bottom gas injectors and side nozzles, containing liquid steel to be refined, and placed in a vacuum tank. Inert gas is injected into liquid steel during the treatment. Gas injected from the bottom is designed to provide sufficient liquid circulation, and slag free surface at the top of the bath. Injection from the side is for the creation of large quantity of smaller bubbles, helping to enhance the liquid circulation, enlarge the top slag-free surface, and increase the activity at the top surface.

Because the static pressure at the side injection site is much lower than that at the bottom under vacuum, the actual gas volume injected from the side is correspondingly expanded, producing more bubbles than under atmospheric pressure.

BRIEF DESCRIPTION OF THE DRAWINGS

An embodiment of the invention will now be described by way of example only with reference to the accompanying drawings in which:

FIG. 1 is a schematic perspective view of a ladle,

FIG. 2 is a plan view of the ladle of FIG. 1,

FIG. 3 is a section on the line III—III of FIG. 2

DETAILED DESCRIPTION WITH RESPECT TO THE DRAWINGS

A ladle 10 has a sidewall 12, and a bottom wall 14. Ladle 10 is located within a tank 16 that may be evacuated by a pump 17. The ladle 10 contains liquid steel, indicated at 18 with proper oxygen and carbon content. The liquid steel has an upper surface 20 which is covered by a slag blanket 22.

The bottom wall 14 includes two bottom injectors 24 of known construction that receives a supply of inert gas. The injectors 24 are positioned at two radii having an included angle of 90° and, at a distance of ½ of the radius from the center of the bottom wall 14. Typically the injectors should be located inside or around a same quadrant of the ladle, so the two rising plumes can slightly approach each other to form a quasi-single circulation loop in the steel bath, but not so close as to merge the plumes. It has been found that the two bottom injectors positioned along two radii with an included angle of 60° to 120°, at distance of ½ to ⅔ of the radius from the center of the bottom operate satisfactorily. They can be of the conventional porous plus type, or directional porous plug type.

A supplementary gas flow is provided by an array of side injectors 30 installed in the sidewall 12 of the ladle 10. Typically, injectors 30 are located 200 to 800 mm below the liquid steel surface 20, inside or around the same quadrant as the bottom injectors 24. Bubbles released from side injectors 30 pump liquid steel 18 up along the ladle wall 14, eliminate the down-flow region between the two bottom injectors, if there is any, and enhance the single-loop liquid circulation, as shown by arrow 26. To avoid any decrease in bubble surface area due to coalescence, side injectors 30 should not be too close to each other. As illustrated four injectors are distributed uniformly within the sector between the bottom nozzles 24 but if only two side injectors 30 are used, at least one should be within the are between the two bottom injectors 24.

In operation therefore, the ladle 10 is placed within the tank 16 and the volume above the upper surface 20 evacuated through pump 17. Inert gas, typically argon is injected through the bottom injectors 24 and side injectors 26 to promote circulation of the steel. The gas moves through the liquid steel to break the surface where it agitates the surface to increase the effective area. The circulation pattern 26 also carries the slag blanket 22 to one side to expose a significant portion of the steel surface 20. As noted above, the gas flow from the side injectors 30 creates a number of relatively small bubbles indicated at 32 to enhance agitation.

Numerous water and liquid metal model studies reveal that the size of bubbles from an injector is mainly a function of the volume flow rate. For the flow rate range appropriate to vacuum decarburization, a more or less constant frequency of bubble release is observed. In the preferred embodiment this fact is used by installing several of the side injectors 30 to increase the number of bubbles. At the position of side injection, the static pressure is 1/10 to ¼ and volume will be 4 to 10 times of that at the bottom. Bubbles from the bottom injectors 24 will expand correspondingly. Therefore, bubbles from side injectors 30 are smaller in size, but larger in number when they arrive at the top surface. The break up of these bubbles can remarkably increase the active area of decarburization, and increase the decarburization rate. The relative flow rate between the bottom and side injectors 30 is 1 to 3 although this may be varied from 0.5 to 8.0 to suit particular conditions.

The gas flow rate from the bottom injectors 24 is limited by the bubble size and consequent splashing at the surface and is therefore maintained at levels typically used in conventional ladles e.g. 50 $Nm^3$/hour. The gas is supplied at a pressure to satisfy the flow rates.

The side injectors 30 each have across sectional are of 1 $cm^2$ to 80 $cm^2$ for the porous plus type or 1 to 20 small nozzles of 0.2 mm to 3 mm, inner diameter for the directional porous plus type.

What is claimed is:

1. A method of promoting the circulation of liquid steel within a ladle having a base and a sidewall upstanding from said base, said method comprising the steps of locating a plurality of gas injectors asymmetrically in said base of said ladle and at positions relative to one another to promote a common circulatory flow path of steel in said ladle; injecting gas through said injectors; and injecting a supplementary flow of gas into said steel at a location adjacent to but below an upper surface of said steel and in a direction complementary to the flow path of steel in said ladle.

2. A method according to claim 1 including the step of locating said gas injectors in a quadrant of said base delimited by radii subtending an angle of between 60 and 90 degrees.

3. A method according to claim 2 wherein said angle is 90 degrees.

4. A method according to claim 2 wherein said injectors are located in said base at a location from a center of said base of between ½ and ⅔ of the distance of the center of said base and said sidewall.

5. A method according to claim 1 including the step of injecting said supplementary flow through injectors located in said said sidewall.

6. A method according to claim 5 including the step of positioning said injectors between 200 mm and 400 mm below said upper surface of said steel in said ladle.

7. A method according to claim 1 wherein the ratio of gas injected through said gas injectors in said base to said supplementary flow is between 0.5 and 8.

8. A method according to claim 7 wherein said ratio is between 1 and 3.

9. A ladle comprising a base, a sidewall extending upwardly from said base, a plurality of injectors in said base positioned asymmetrically on said base located relative to one another to promote a common circulatory flow path of steel in said ladle, and at least one side nozzle located in said sidewall below an upper surface of said steel and positioned to complement the flow path of steel in said ladle.

10. A ladle according to claim 9 wherein said gas injector are in quadrant of said base delimited by radii subtending an angle of between: 60 and 90 degrees.

11. A ladle according to claim 10 wherein said angle is 90 degree.

12. A ladle according to claim 10 wherein said injectors are located in said base at a location from the center of said base of between ½ and ⅔ of the distance of the centre of said base and said sidewall.

13. A ladle according to claim 9 wherein a plurality of side nozzles are located in said sidewall.

14. A ladle according to claim 9 wherein each of said side nozzles are positioned within said quadrant.

15. A ladle according to claim 14 wherein each of said side nozzles are positioned within said quadrant.

16. A ladle according to claim 13 wherein said side nozzles are positioned between 200 mm and 400 mm below said upper surface of said steel in said ladle.

17. A ladle according to claim 13 wherein the ratio of gas flow rate injected through said gas injectors in said base to said side nozzles is between 0.5 and 8.

18. A ladle according to claim 17 wherein said ratio is between 1 and 3.

19. A method of promoting circulation of liquid steel within a ladle comprising the steps of injecting a gaseous stream into the liquid steel to promote a common circulatory flow upwardly along one side of said ladle and downwardly along another side of said ladle, wherein said circulation promoted by injecting a first flow of gas from a base of said ladle and a second flow of gas from a sidewall of said ladle at a location elevated from said base but below an upper surface of said steel.

20. A method according to claim 19 wherein said first flow of gas is injected from a location offset from the center of said base.

21. A method according to claim 20 wherein said second flow of gas is injected substantially parallel to said base and in a direction complementary to said common circulatory flow.

22. A method according to claim 21 wherein said first and second flows of gas are aligned in a common quadrant of said ladle.

* * * * *